US007699943B2

(12) United States Patent
Nakano et al.

(10) Patent No.: US 7,699,943 B2
(45) Date of Patent: Apr. 20, 2010

(54) METHOD FOR MANUFACTURING HIGH-STRENGTH SPRING

(75) Inventors: Tomohiro Nakano, Nagoya (JP); Takayuki Sakakibara, Nagoya (JP); Masami Wakita, Nagoya (JP)

(73) Assignee: Chuo Hatsujo Kabushiki Kaisha, Nagoya-shi (JP)

( * ) Notice: Subject to any disclaimer, the term of this patent is extended or adjusted under 35 U.S.C. 154(b) by 293 days.

(21) Appl. No.: 10/546,833

(22) PCT Filed: Mar. 24, 2004

(86) PCT No.: PCT/JP2004/004106

§ 371 (c)(1), (2), (4) Date: Aug. 25, 2005

(87) PCT Pub. No.: WO2004/085685

PCT Pub. Date: Oct. 7, 2004

(65) Prior Publication Data

US 2006/0060269 A1 Mar. 23, 2006

(30) Foreign Application Priority Data

Mar. 26, 2003 (JP) ..... 2003-085194

(51) Int. Cl.
*C21D 9/02* (2006.01)

(52) U.S. Cl. ..... 148/333; 148/335; 148/320; 148/580; 148/908; 72/52; 29/90.7

(58) Field of Classification Search ..... 148/580, 148/908, 320, 333–335; 29/90.7; 72/53
See application file for complete search history.

(56) References Cited

U.S. PATENT DOCUMENTS 6,193,816 B1 2/2001 Nakano et al.

FOREIGN PATENT DOCUMENTS

| | | | |
|---|---|---|---|
| JP | A 45-241 | 1/1970 | |
| JP | A 48-20969 | 3/1973 | |
| JP | A 58-213825 | 12/1983 | |
| JP | 361124521 | * 6/1986 | ..... 72/54 |
| JP | A 63-267164 | 11/1988 | |

(Continued)

OTHER PUBLICATIONS

English translation of Japanese patent 86124521, Toru Yamaguchi, Jun. 12, 1986.*

(Continued)

*Primary Examiner*—Deborah Yee
(74) *Attorney, Agent, or Firm*—Oliff & Berridge, PLC

(57) ABSTRACT

The present invention intends to provide a method for manufacturing a high-strength spring, which is capable of generating a higher level of compressive residual stress than that given by conventional methods. This object is achieved as follows: After the final heating process, such as the tempering (in the case of a heat-treated spring) or removing-strain annealing (in the case of a cold-formed spring), a shot peening process is performed on the spring while the surface temperature of the spring is within the range from 265 to 340° C. (preferably from 300 to 340° C.). Subsequently, the spring is rapidly cooled. Preferably, a prestressing process is performed before the shot peening process, or after the shot peening process and before the rapid cooling process. The rapid cooling process may be either a water-cooling process or an oil-cooling process. A forced-air cooling process may be used if the wire diameter of the spring is small.

19 Claims, 4 Drawing Sheets

FOREIGN PATENT DOCUMENTS

| | | |
|---|---|---|
| JP | A 5-140643 | 6/1993 |
| JP | A 11-241143 | 9/1999 |
| WO | WO 00/75381 | 12/2000 |

OTHER PUBLICATIONS

English translation of Japanese patent 63267164, Takeshi Naito, Nov. 4, 1988.*

English abstract of Japanese patent 408155572, Ikeda, Hiroshi, Jun. 18, 1996.*

Derwent Acc No. 1987-232106, English abstract of Japanese patent 62156251.*

Derwent publication Acc-No. 1979-54595B, Heinke et al., English abstract of DD135401A, May 2, 1079.*

* cited by examiner

CHEMICAL COMPOSITION OF SAMPLE (mass%)

| C | Si | Mn | P | S | Ni | Cr | V | N |
|---|---|---|---|---|---|---|---|---|
| 0.49 | 1.99 | 0.70 | 0.009 | 0.007 | 0.59 | 0.25 | 0.19 | 0.0062 |

Fig. 3
DIMENSIONS OF SAMPLE SPRING
| WIRE DIAMETER (mm) | COIL DIAMETER (mm) | TOTAL NUMBER OF TURNS | NUMBER OF ACTIVE TURNS | FREE LENGTH (mm) | SPRING CONSTANT (N/mm) |
|---|---|---|---|---|---|
| $\phi$ 12.9 | $\phi$ 150 | 5.15 | 3.65 | 349 | 22.5 |
Fig. 4A
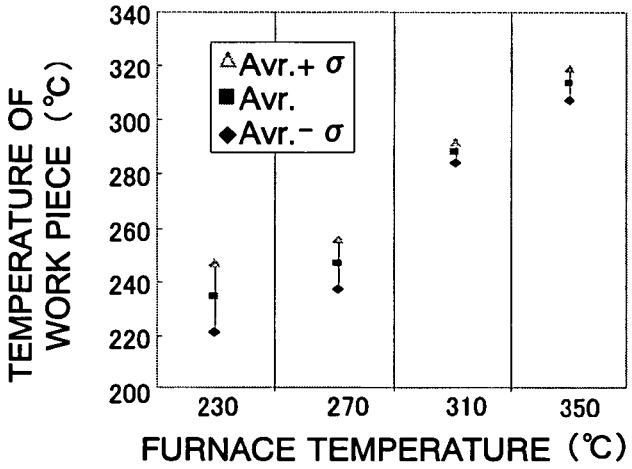
Fig. 4B
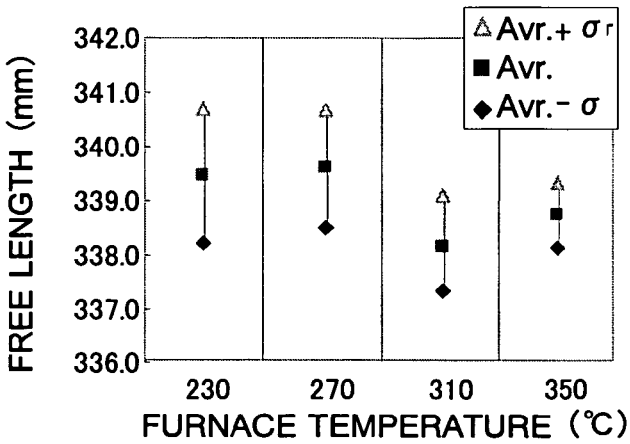

WATER : WATER-COOLED
AIR : AIR-COOLED
COLD : COLD-WORKED

METHOD FOR MANUFACTURING HIGH-STRENGTH SPRING

TECHNICAL FIELD

The present invention relates to a shot peening method for manufacturing a spring, particularly a suspension spring, having a high level of durability (or fatigue resistance) and sag resistance.

BACKGROUND ART

As a method for remarkably improving the durability of a spring, shot peening is an indispensable process for a high-strength spring, especially for a suspension spring used in automobiles or a valve spring used in engines.

In the shot peening process, a number of small particles are projected onto the surface of the target object. This process is apparently the same as the shot blast, a process that is performed to make the surface clean by removing burrs (or projections) resulting from cutting or forming work or scales (i.e. a hard oxide layer) resulting from a heat treatment. However, the two processes significantly differ from each other in respect to the strength and other conditions; for shot peening, the conditions are determined to cause a plastic deformation only on the surface of the spring so that a compressive stress remains on the surface.

The main purpose of shot-peening a spring is to generate beforehand a compressive residual stress within the surface of the spring so that the load stress working on the spring when it is in service is reduced by an amount equal to the residual stress. For this purpose, various shot peening methods have been developed to attain as high a residual stress as possible.

For example, the Japanese Examined Patent Publication No. S48-20969 discloses a technique in which a piece of spring steel having a sorbite structure is shot-peened under a warm environment with a temperature of 200 to 400° C. after the quenching and tempering processes.

The Japanese Unexamined Patent Publication No. S58-213825 discloses a technique in which the shot peening is performed while the temperature of the spring is within the range from 150 to 350° C. in the course of the cooling process after the temper-heating process.

The Japanese Unexamined Patent Publication No. H05-140643 discloses a technique for generating an adequate level of compressive residual stress, in which a piece of steel having a predetermined composition undergoes a warm shot peening process while the temperature is maintained within the range from 150 to 300° C. after the thermal refining process, i.e. the quenching and tempering processes.

The techniques disclosed in the aforementioned three publications were first developed in the days when springs were used under low levels of working stress. Such past techniques could not always meet the performance requirements for the latest springs that were put in service under much higher levels of working stress.

To solve such a problem, the present invention intends to provide a method for manufacturing a high-strength spring, which is capable of generating a higher level of compressive residual stress than that generated by conventional methods.

DISCLOSURE OF THE INVENTION

To solve the above-described problem, the method for manufacturing a high-strength spring according to the present invention is characterized by:

a shot peening process performed on the spring while the surface temperature of the spring is within the range from 265 to 340° C., and a rapid cooling process performed on the spring after the shot peening process.

It is preferable to perform a setting process before the shot peening process, or after the shot peening process and before the rapid cooling process.

The rapid cooling process may be either a water-cooling process or an oil-cooling process. A forced-air cooling process is also available if the wire diameter of the spring is small.

The above-described method exhibits a more remarkable effect if it is applied to a spring made of a steel material containing, in weight percentage, 0.35 to 0.55% of C, 1.60 to 3.00% of Si, 0.20 to 1.50% of Mn, 0.010% or less of S, 0.40 to 3.00% of Ni, 0.10 to 1.50% of Cr, 0.010 to 0.025% of N and 0.05 to 0.50% of V, with Fe substantially constituting the remaining percentage.

To improve the energy efficiency, it is preferable to perform the above-described process when the spring is cooled after a certain kind of heating process is performed on the spring. For a spring that needs a heating treatment (i.e. quenching and tempering), the aforementioned "heating process" means the final heating process (i.e. the tempering). For a spring that does not need such a heating treatment, the "heating process" means some other kind of heating process, an example of which is a removing-strain annealing performed after a cold-working process (e.g. coiling process). For a warm-formed spring, the temper heating is usually performed at a temperature within the range from 400 to 450° C. For a cold-formed spring, the removing-strain annealing that follows the coiling process is performed at a temperature within the range from 350 to 450° C. Therefore, the shot peening, prestressing and other necessary processes can be performed within the temperature range specified earlier. It is allowable to provide an additional heating step apart from the "heating process." In this case, the shot peening and related processes may be performed while the heating operation is maintained, not in the course of a cooling process after the heating operation is stopped.

If the shot peening is performed in a warm environment where the spring still has a high temperature, the hardness of the spring (or work piece) relative to that of the shot particles becomes lower than that observed in the case where the shot peening is performed in a cold environment. Therefore, the shot peening produces a greater magnitude of plastic deformation on the surface of the spring, thereby generating a high level of compressive residual stress within the surface. It also makes the compressive residual stress to develop more deeply from the surface.

In conventional methods, the spring is made to cool naturally after the warm shot peening. For example, if, as in the case of a suspension spring, the wire diameter of the spring is as large as 10 to 15 mm, it takes more than five minutes for the temperature to fall from 300 to 200° C. Leaving the spring under such a warm environment for such a long time will cause a relaxation of the high compressive residual stress.

In the method according to the present invention, a rapid cooling process immediately follows the shot peening process performed at the above-specified temperature range. Therefore, the high compressive residual stress resulting from the warm shot peening is maintained until the spring reaches the room temperature. Thus, the spring manufactured by the method according to the present invention gains a higher level of durability.

The previous discussion also applies to the prestressing process. One object of performing the prestressing in a warm environment is to cause beforehand, in the course of the production, a plastic deformation (or sag) that can occur in the future while the spring is in service, and to immobilize beforehand any dislocations that may cause a plastic deformation. Performing a slow cooling process after the warm prestressing process allows the dislocations to move again while the temperature is high, which will cause the spring to sag in the future. In contrast, in the method according to the present invention, the rapid cooling process that immediately follows the warm prestressing process assuredly immobilizes the dislocations, so that only a minimal amount of sag is allowed to occur later while the spring is in service.

Furthermore, compared to the cold prestressing performed after the spring is cooled, the warm prestressing reduces the amount of compression of the spring necessary to create the same magnitude of permanent deformation. This effectively improves the evenness in the form (e.g. the free length and the bowing) of the spring observed after the prestressing.

BRIEF DESCRIPTION OF THE DRAWINGS

FIG. 3 is a table showing the dimensions of the sample spring.

FIG. 4A is a graph showing the relationship between the temperature at the exit of the temper furnace and the temperature of the work piece, and FIG. 4B is a graph showing the relationship between the temperature at the exit of the temper furnace and the free length of the work piece observed after a warm prestressing process.

BEST MODE FOR CARRYING OUT THE INVENTION

Figures 1, 2:
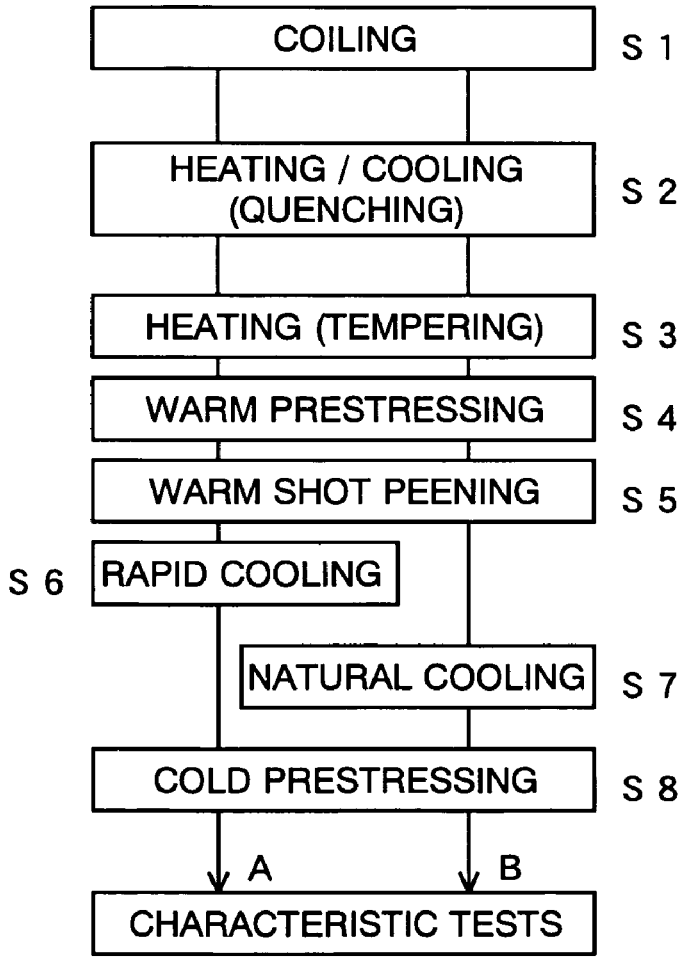
FIG. 1 is a table showing the chemical composition of a sample spring.
FIG. 2 is a flowchart showing the process of manufacturing the sample spring.

A test for confirming the effect of the method according to the present invention was conducted using a steel material having a chemical composition shown in FIG. 1. Several pieces of coil springs were manufactured by a process shown in FIG. 2. The dimensions of the coil springs are shown in FIG. 3.

As shown in FIG. 2, the test samples were divided into two groups (A) and (B). The sample springs belonging to group (A) were prestressed and shot-peened in a warm environment where the temperature of the springs was within the range from 265 to 340° C. Then, the springs were submerged under water for rapid cooling. In contrast, the springs of group (B) were naturally cooled (or air-cooled) after being prestressed and shot-peened in the same manner. The shot peening was performed under the following condition: arc height=0.37 mm, coverage=100%.

A tempering treatment for a spring includes the step of maintaining a quenched spring at a predetermined tempering temperature for a specified period of time. In general, the process of manufacturing springs for mass-production uses a conveyor-type temper furnace. This type of furnace allows the temperature at its exit to be set at desired values after the tempering process is performed at a predetermined temperature for a predetermined period of time. This means that the temperature of the spring (or work piece) can be set as desired for the warm shot peening process and the warm prestressing process. Therefore, research was conducted on the relationship between the temperature at the exit of the temper furnace and the temperature of the spring (or work piece) observed immediately after they had exited the furnace. The result is shown in FIG. 4A, which demonstrates that a rise in the temperature at the exit of the furnace improves the evenness in the temperature of the work.

FIG. 4B shows the relationship between the temperature at the exit of the same furnace and the free length of the spring observed after the warm prestressing process. It also demonstrates that a rise in the temperature at the exit of the furnace improves the evenness in the free length of the work piece. This is because the warm prestressing reduces the amount of compression of the spring and accordingly lowers the level of stress applied to the spring.

The above-described results demonstrate that it is possible to manufacture springs having an improved evenness in form by setting the temperature at the exit of the temper furnace high enough for the temperature of the spring to be as high as 265 to 340° C. (preferably 300° C. or higher) during the warm prestressing process and the warm shot peening process.

Figure 5:
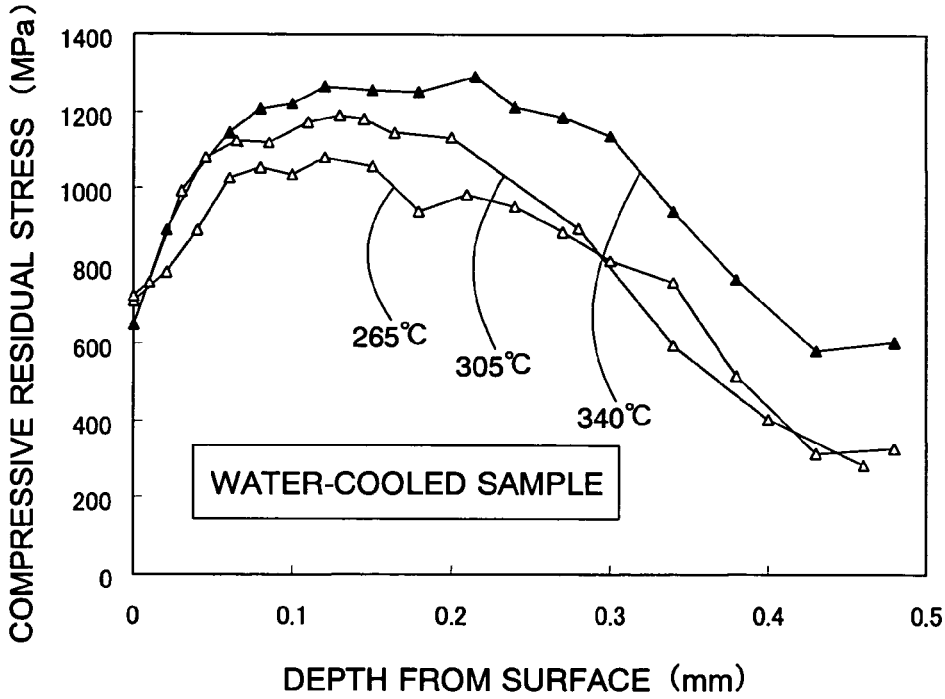
FIG. 5 is a graph showing the compressive residual stress distribution on the surface of rapidly cooled samples.

Next, the characteristics of the springs manufactured as described above were examined. For the water-cooled group (A), three kinds of springs were manufactured by setting the temperature at the beginning of the shot peening process to three different values: 265, 305 and 340° C. FIG. 5 shows the result of measuring the residual stress distribution from the surface to a depth of 0.5 mm for each of the three kinds of springs. Every spring exhibits the maximum compressive residual stress of over 1000 MPa. Moreover, the stress does not fall below 800 MPa until the depth reaches a level of 0.3 mm.

Figure 6:
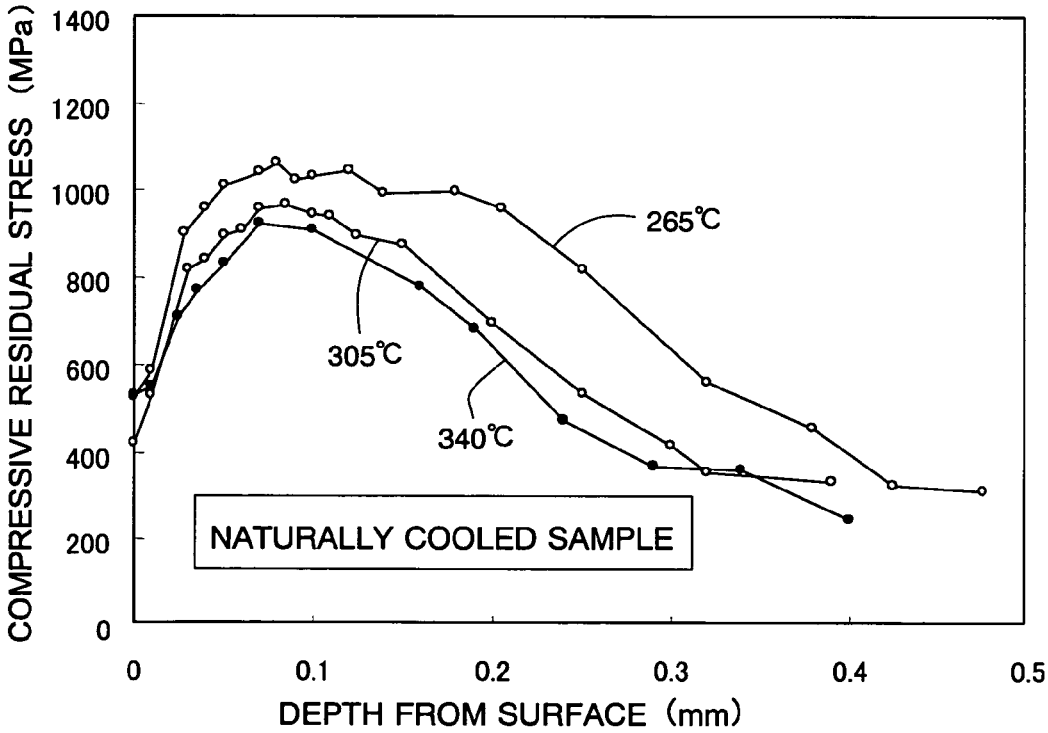
FIG. 6 is a graph showing the compressive residual stress distribution on the surface of naturally cooled samples.

For the naturally cooled group (B), three kinds of springs were manufactured by setting the temperature at the beginning of the shot peening process to three different values: 265, 305 and 340° C. FIG. 6 shows the result of measuring the residual stress distribution from the surface to a depth of 0.5 mm for each of the three kinds of springs. Again, every spring exhibits the maximum compressive residual stress of over 1000 MPa. However, except for the spring treated under the temperature of 265° C., the stress falls below 800 MPa when the depth reaches a level of about 0.15 to 0.20 mm.

It is possible to carry out the shot peening process a plurality of times. A shot peening process may be a stress peening process, whenever necessity.

Figure 7:
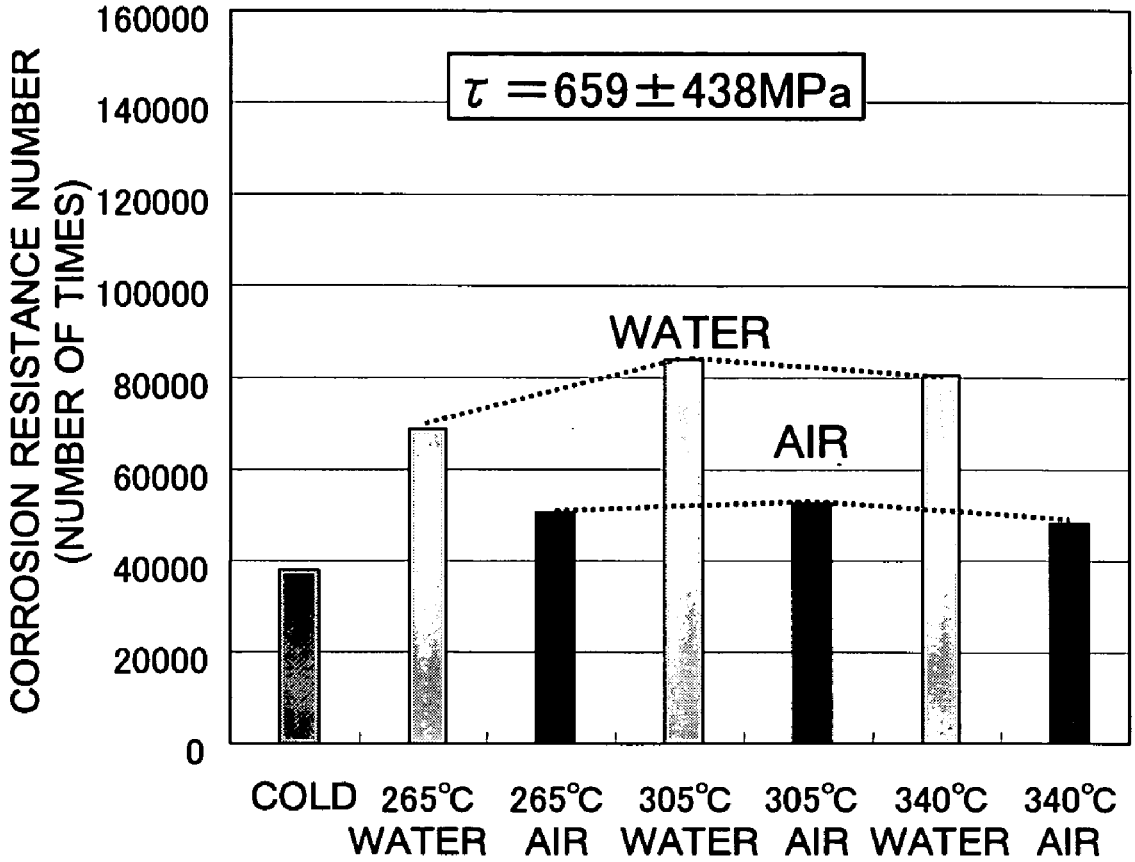
FIG. 7 is a graph showing the result of a corrosion resistance test of the sample spring.

FIG. 7 shows the result of a corrosion resistance test performed on the springs of the two groups (A) and (B). The test was conducted under the conditions specified in the figure. FIG. 7 clearly shows that the springs rapidly cooled after the warm shot peening and warm prestressing processes have higher levels of durability than those of the naturally cooled springs.

The invention claimed is:

1. A method for manufacturing a high-strength spring, comprising:

a heating process performed on the spring for heating the spring at a temperature within a range from 350 to 450° C.;

a warm prestressing process performed on the spring after the heating process while a surface temperature of the spring is within a range from 265 to 340° C.;

a shot peening process performed on the spring after the warm prestressing process while a surface temperature of the spring is within a range from 265 to 340° C.;

a rapid cooling process performed on the spring after the shot peening process; and a cold prestressing process performed after the rapid cooling process.

2. A method for manufacturing a high-strength spring, comprising:

a heating process performed on the spring for heating the spring at a temperature within a range from 350 to 450° C.;

a warm prestressing process performed on the spring after the heating process while a surface temperature of the spring is within a range from 300 to 340° C.;

a shot peening process performed on the spring after the warm prestressing process while a surface temperature of the spring is within a range from 300 to 340° C.;

a rapid cooling process performed on the spring after the shot peening process; and a cold prestressing process performed after the rapid cooling process.

3. A method for manufacturing a high-strength spring, comprising:

a heating process performed on the spring for heating the spring at a temperature within a range from 350 to 450° C.;

a warm prestressing process performed on the spring after the heating process while a surface temperature of the spring is within a range from 265 to 340° C. while the spring is cooled after the heating process;

a shot peening process performed on the spring after the warm prestressing process while a surface temperature of the spring is within the range from 265 to 340° C.;

a rapid cooling process performed on the spring after the shot peening process; and a cold prestressing process performed after the rapid cooling process.

4. A method for manufacturing a high-strength spring, comprising:

a heating process performed on the spring for heating the spring at a temperature within a range from 350 to 450° C.;

a warm prestressing process performed on the spring after the heating process while a surface temperature of the spring is within a range from 300 to 340° C. while the spring is cooled after the heating process;

a shot peening process performed on the spring after the warm prestressing process while a surface temperature of the spring is within a range from 300 to 340° C.;

a rapid cooling process performed on the spring after the shot peening process; and a cold prestressing process performed after the rapid cooling process.

5. The method for manufacturing a high-strength spring according to claim 1, wherein the shot peening process is performed a plurality of times.

6. The method for manufacturing a high-strength spring according to claim 1, wherein a stress peening process is performed in the shot peening process.

7. The method for manufacturing a high-strength spring according to claim 1, wherein the rapid cooling process is a water-cooling process.

8. The method for manufacturing a high-strength spring according to claim 1, wherein the aforementioned processes are performed on a spring made of a steel material containing, in weight percentage, 0.35 to 0.55% of C, 1.60 to 3.00% of Si, 0.20 to 1.50% of Mn, 0.010% or less of 5, 0.40 to 3.00% of Ni, 0.10 to 1.50% of Cr and 0.05 to 0.50% of V, with Fe substantially constituting the remaining percentage.

9. The method for manufacturing a high-strength spring according to claim 3, wherein the heating process is a temper-heating process performed in a quenching and tempering treatment.

10. The method for manufacturing a high-strength spring according to claim 3, wherein the heating process is a heating process for removing-strain annealing performed after a cold-working process.

11. A high-strength spring, manufactured by a method comprising:

a heating process performed on the spring for heating the spring at a temperature within a range from 350 to 450° C.;

a warm prestressing process performed on the spring after the heating process while a surface temperature of the spring is within a range from 300 to 340° C.;

a shot peening process performed on the spring after the warm prestressing process while a surface temperature of the spring is within a range from 300 to 340° C.;

a rapid cooling process performed on the spring after the shot peening process; and a cold prestressing process performed after the rapid cooling process, wherein the spring is made of a steel material containing, in weight percentage, 0.35 to 0.55% of C, 1.60 to 3.00% of Si, 0.20 to 1.50% of Mn, 0.010% or less of S, 0.40 to 3.00% of Ni, 0.10 to 1.50% of Cr and 0.05 to 0.50% of V, with Fe substantially constituting the remaining percentage, and a duration of the spring in a corrosion fatigue test exceeds 60,000 cycles under a stress of 659±438 MPa.

12. A high-strength spring, manufactured by a method comprising:

a heating process performed on the spring for heating the spring at a temperature within a range from 350 to 450° C.;

a warm prestressing process performed on the spring after the heating process while a surface temperature of the spring is within a range from 265 to 340° C. while the spring is cooled after the heating process;

a shot peening process performed on the spring after the warm prestressing process while a surface temperature of the spring is within the range from 265 to 340° C.;

a rapid cooling process performed on the spring after the shot peening process; and a cold prestressing process performed after the rapid cooling process, wherein the spring is made of a steel material containing, in weight percentage, 0.35 to 0.55% of C, 1.60 to 3.00% of Si, 0.20 to 1.50% of Mn, 0.010% or less of S, 0.40 to 3.00% of Ni, 0.10 to 1.50% of Cr and 0.05 to 0.50% of V, with Fe substantially constituting the remaining percentage, and a duration of the spring in a corrosion fatigue test exceeds 60,000 cycles under a stress of 659±438 MPa.

13. A high-strength spring, manufactured by a method comprising:

a heating process performed on the spring for heating the spring at a temperature within a range from 350 to 450° C.;

a warm prestressing process performed on the spring after the heating process while a surface temperature of the spring is within a range from 300 to 340° C. while the spring is cooled after the heating process;

a shot peening process performed on the spring while a surface temperature of the spring after the warm prestressing process is within the range from 300 to 340° C.;

a rapid cooling process performed on the spring after the shot peening process; and a cold prestressing process performed after the rapid cooling process, wherein the spring is made of a steel material containing, in weight percentage, 0.35 to 0.55% of C, 1.60 to 3.00% of Si, 0.20 to 1.50% of Mn, 0.010% or less of 5, 0.40 to 3.00% of Ni, 0.10 to 1.50% of Cr and 0.05 to 0.50% of V, with Fe substantially constituting the remaining percentage, and a duration of the spring in a corrosion fatigue test exceeds 60,000 cycles under a stress of 659±438 MPa.

14. A high strength spring, manufactured by a method comprising:

a heating process performed on the spring for heating the spring at a temperature within a range from 350 to 450° C.;

a warm prestressing process performed on the spring after the heating process while a surface temperature of the spring is within a range from 265 to 340° C.;

a shot peening process performed on the spring after the warm prestressing process while a surface temperature of the spring is within a range from 265 to 340° C., and a rapid cooling process performed on the spring after the shot peening process; and a cold prestressing process performed after the rapid cooling process, wherein the spring is made of a steel material containing, in weight percentage, 0.35 to 0.55% of C, 1.60 to 3.00% of Si, 0.20 to 1.50% of Mn, 0.010% or less of S, 0.40 to 3.00% of Ni, 0.10 to 1.50% of Cr and 0.05 to 0.50% of V, with Fe substantially constituting the remaining percentage, a duration of the spring in a corrosion fatigue test exceeds 60,000 cycles under a stress of 659±438 MPa.

15. The high strength spring according to claim 14, wherein the shot peening process is performed a plurality of times.

16. The high strength spring according to claim 14, wherein a stress peening process is performed in the shot peening process.

17. The high strength spring according to claim 14, wherein the rapid cooling process is a water-cooling process.

18. The high strength spring according to claim 12, wherein the heating process is a temper-heating process performed in a quenching and tempering treatment.

19. The high strength spring according to claim 12, wherein the heating process is a heating process for removing-strain annealing performed after a cold-working process.

* * * * *